US007625686B2

(12) United States Patent
Ohmura et al.

(10) Patent No.: US 7,625,686 B2
(45) **Date of Patent: *Dec. 1, 2009**

(54) IMAGE FORMING METHOD

(75) Inventors: Ken Ohmura, Hachioji (JP); Hiroshi Yamazaki, Hachioji (JP); Asao Matsushima, Hino (JP); Eiichi Yoshida, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 403 days.

This patent is subject to a terminal disclaimer.

(21) Appl. No.: 10/791,480

(22) Filed: Mar. 2, 2004

(65) Prior Publication Data

US 2004/0209183 A1 Oct. 21, 2004

(30) Foreign Application Priority Data

Mar. 6, 2003 (JP) ..... 2003-059760

(51) Int. Cl.
*G03G 21/10* (2006.01)
*G03G 9/087* (2006.01)

(52) U.S. Cl. ..... 430/119.88; 430/109.4; 430/110.3; 430/119.87

(58) Field of Classification Search ..... 430/110.3, 430/109.4, 125, 119.86, 119.87, 119.88; 399/359, 253

See application file for complete search history.

(56) References Cited

U.S. PATENT DOCUMENTS

| | | | | |
|---|---|---|---|---|
| 5,387,665 | A * | 2/1995 | Misawa et al. | 528/81 |
| 5,521,690 | A * | 5/1996 | Taffler et al. | 399/93 |
| 6,395,442 | B1 * | 5/2002 | Hayashi et al. | 430/109.4 |
| 6,528,224 | B2 * | 3/2003 | Ohno et al. | 430/108.8 |
| 6,844,126 | B2 * | 1/2005 | Ohmura et al. | 430/110.3 |
| 7,150,952 | B2 * | 12/2006 | Matsushima et al. | 430/108.1 |
| 7,378,208 | B2 * | 5/2008 | Ohmura et al. | 430/108.4 |
| 2003/0027066 | A1 | 2/2003 | Yamashita et al. | |
| 2003/0113647 | A1 * | 6/2003 | Matsushima et al. | 430/108.1 |
| 2003/0148204 | A1 * | 8/2003 | Ohmura et al. | 430/110.3 |

FOREIGN PATENT DOCUMENTS

| | | |
|---|---|---|
| JP | 55-041414 | 3/1980 |
| JP | 06-337589 | 12/1994 |
| JP | 10-319813 | * 12/1998 |
| JP | 2000-010333 | * 1/2000 |
| JP | 2002-296839 | 10/2002 |
| JP | 2002-351140 | 12/2002 |

OTHER PUBLICATIONS

Japanese Patent Office machine-assisted translation of JP 2000-010333 (pub. Jan. 2000).*
Japanese Patent Office machine-assisted translation of JP 10-319813 (pub. Dec. 1998).*
USPTO English-language translation of JP 10-319813 (pub. Dec. 1998).*

* cited by examiner

*Primary Examiner*—Janis L Dote
(74) *Attorney, Agent, or Firm*—Lucas & Mercanti, LLP

(57) ABSTRACT

An image forming method in which toner having a an average circularity of 0.94-0.99, and an average equivalent circle diameter of 2.6-7.4 μm of toner particles is utilized, an electrostatic latent image formed on an image carrying member being developed, and the toner image is transferred on a transferring material followed by fixing, wherein non-transferred toner remaining on said image carrying member is collected for reuse for image formation, and non-transferred toner collected is utilized after having been passed through a toner intermediate chamber.

11 Claims, 3 Drawing Sheets

IMAGE FORMING METHOD

FIELD OF THIS INVENTION

The present invention relates to an image forming method in which an electrostatic latent image formed on an image carrying member is developed and the formed toner image is transferred on a transfer material followed by fixing, and particularly to an image forming method in which unfixed toner remaining on the image carrying member is reused.

DESCRIPTION OF RELATED ART

An image forming method of a print-on-demand mode, which prints as many copies as desired is an embodiment of digital image formation. An image formation employing this mode becomes an important image forming method to replace small run printing, because a few million of copies can be printed without the requirement of plate making, which is necessary in conventional printing. It is also used in preparation of direct mailing or invitations can be printed with individual addresses.

In image formation of digital mode, toner featuring a minute particle diameter is essential to exhibit excellent fine line reproducibility and high resolution, for example, as represented by developing a dense dot image of as minute as 1200 dpi (the number of dots per 1 inch, or 2.54 cm).

A toner image formed on an image carrying member of an electrophotographic copier is not completely transferred onto a transfer sheet, and non-transferred toner remains. To perform continuous copying operation, it is necessary to remove the residual toner from the image carrying member.

Non-transferred toner remaining on such an image carrying member is generally removed by use of a cleaning device such as a cleaning blade, or the like, and collected into a waste toner tank. Since efficient utilization of resources and reduction of operation cost have become critical in recent years, known is an image forming apparatus in which residual toner, having been collected by a cleaning device (for example, Japanese Patent Publication No. 63-3308), is returned to the developing device or a toner replenishing device by a transport device for collected toner and is mixed with new toner to be reused for toner image formation on the image carrying member.

In the transport device of collected toner employing a powder screw pump described above, the collected toner being collected and transported by a cleaning means contains a significant amount of foreign materials such as paper dust, toner particles broken during the transfer process and large toner aggregates. When these foreign materials are returned as they are to such the developing means to be reused, abnormal images often result such as white spots or black spots being generated on an image due to paper dust or toner aggregates, which is a problem with respect to image quality. Conventionally proposed has been a classification device which performs classification by providing a sieve member as a filter means in the transport path of collected toner to classify the reusable toner contained in the toner collected after image formation [For example, JP-A No. 6-337589 (hereinafter, JP-A refers to Japanese Patent Publication Open to Public Inspection)].

It is important, as described above, to capture the waste toner at the time of image formation to promote saving of resources and cost reduction by utilizing non-transferred toner remained on the image carrying member for image formation.

However, it has been difficult to sufficiently eliminate foreign materials (impurities) such as paper dust and large toner aggregates in non-transferred toner collected by a cleaning means, employing a separation method, of paper dust and the like in the collected toner as described above.

Further, dust like paper dust often adheres on the paper sheet surface when plain paper, other than exclusive copy paper is employed, and in such a case causes problems such as paper dust and the like adhering to a paper surface may be transferred onto the image carrying member at the time of toner image formation, and then mixed with residual non-transferred toner. In such a case, sufficiently satisfactory image formation becomes difficult due to generation of white spots or black spots because paper dust and the like are mixed in the toner, as when non-transferred toner is collected and reused.

In the case of image formation in a print-on demand mode, there may be cases in which a toner image is formed not only on plain paper, but also on paper such as a post card as an image forming medium. In the case of forming a toner image on such thick paper stock, and since pressure applied onto toner particles is so high as to being no comparison with that of forming a toner image on plain paper, the toner particles themselves of non-transferred toner remaining on an image carrying member are liable to be broken by this high pressure. Broken toner particles are degraded in capability as toner and provide unsatisfactory image formation, as when non-transferred toner remaining on an image carrying member is collected and reused.

Further, impurities such as aggregated toner particles and isolated additives in addition to impurities such as paper dust and broken toner particles are likely to cause irregular in image formation.

The present invention has been developed in view of these problems. That is, an objective of this invention is to provide an image forming method which can form sufficiently satisfactory images with respect to various types of recording media by efficiently eliminating impurities contained in toner, and contribute to resource saving and cost reduction.

SUMMARY

An image forming method comprising the steps of developing an electrostatic latent image formed on an image carrying member for forming a toner image with toner comprising toner particles having an average circularity of 0.94-0.99 as well as an average an equivalent circular diameter of 2.6-7.4 μm, transferring toner image onto a transferring material, collecting non-transferred toner remaining on the image carrying member to be reused for further image formation, and making the collected non-transferred toner pass through an toner intermediate chamber.

An image forming apparatus capable of toner recycling comprising a toner receiving section, a toner feeding section which transfers toner to the toner receiving section, a toner intermediate chamber through which the toner passes at the time of toner transport to the aforesaid toner feeding section and to the aforesaid toner receiving section, a transport tube which connects the aforesaid toner intermediate chamber and the toner receiving section and which transports toner from the intermediate chamber to the toner receiving section, and a transport device to transport toner from the intermediate chamber by a gas stream, wherein the toner has an average circularity of 0.94-0.99 and an average equivalent circle diameter of 2.6-7.4 μm.

DETAILED DESCRIPTION OF THE PREFERRED EMBODIMENT

In an image forming method of this invention, excess stress applied on toner is reduced to decrease burying of external additives in recycled toner, and impurities such as paper dust and toner granules can be removed. As a result, prevented can be debris inside the apparatus due to spattering of such as paper dust and toner granules. Further, stable images can be formed over a long period of time because no variation of static charge buildup results due to the prevention of burying of external additives. Particularly, it is effective for toner prepared by aggregating resin particles dispersed in a water-based medium.

This invention will be detailed in the following paragraphs, however, this invention is not limited thereto. Changes and substitutions apparent to those skilled in art should be construed as being included in this invention.

Figure 1:
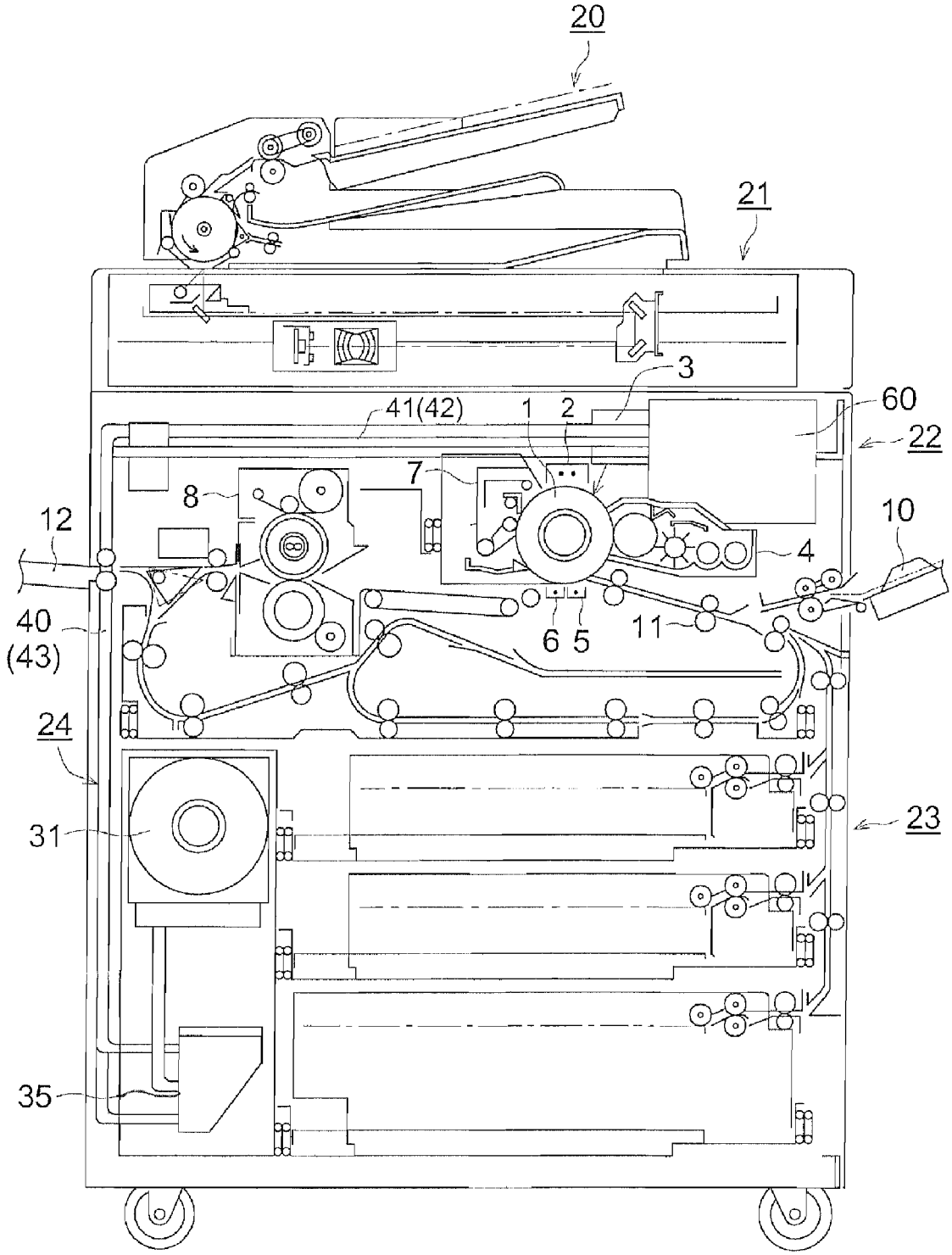
FIG. 1 is a cross-sectional drawing of an example of an image forming apparatus utilized in an image forming method of this invention.

An example of an image forming apparatus utilized in this invention is shown in FIG. 1.

In FIG. 1, automatic original copy transport device 20 transports an original copy placed on the original copy supplying table to a scanning position one by one and accumulates the original copies, after having been scanned on the original copy delivery tray.

Original copy scanning section 21 scans the image and text of the original copy to generate digital image data. Image forming section 22 forms an image on a recording sheet by means of an electrophotographic method.

In image forming section 22, charging device 2, exposure device 3, development device 4, transfer device 5, separation device 6 and cleaning device 7 are situated around drum-shaped photosensitive element 1 which is an image carrying member of this invention. Cleaning device 7 collects unfixed toner remaining on photosensitive element 1. Paper feeding section 23 equipped with a plural number of recording paper storing cassettes is provided under image forming section 22 and supplies recording paper to image forming section 22, while 10 is a manual paper feeding section. Recording paper fed from paper feeding section 23 or manual paper feeding section 10 is supplied between photosensitive element 1 and transfer device 5 by register rollers 11 and subjected to a fixing treatment by fixing device 8 after which it is delivered to copy delivery tray 12.

A toner image is formed on photosensitive element 1 by static charges placed by charging device 2, image-wise exposure by exposure device 3 and development by developing device 4, corresponding to the clock-wise rotation of photosensitive element 1. The formed toner image is transferred onto a recording sheet by use of transfer device 5. The recording sheet, on which a toner image has been transferred, is fixed by fixing device 8 followed by delivery to copy delivery tray 12.

Development device 4 develops the electrostatic latent image employing a double-component developer containing a toner and a carrier or a single-component developer containing no carrier, but a toner, or a toner and additives. When toner is consumed by development in development device 4, toner is transported and supplied from toner container 31 by transport device 24 so that toner density of the developer in development device 4 is always maintained at a predetermined value. The unfixed toner collected in cleaning device 7 is flown into toner transport device 24.

A toner feeding section is equipped with toner container 31. The toner feeding section is provided with toner hopper 30 as an example of a toner supply section incorporating funnel-shaped mixing chamber 35 (being a mixing chamber of toner and air), and toner separation section 60 being situated in the vicinity of development section 4 and a toner feeding section being situated at a position far from development section 4, are connected by transport tube 40, 41, 42 or 43. In this example, shown is an embodiment in which toner is transported to development section 4 by a gas stream, however, this invention is not necessarily limited thereto.

Figure 2:
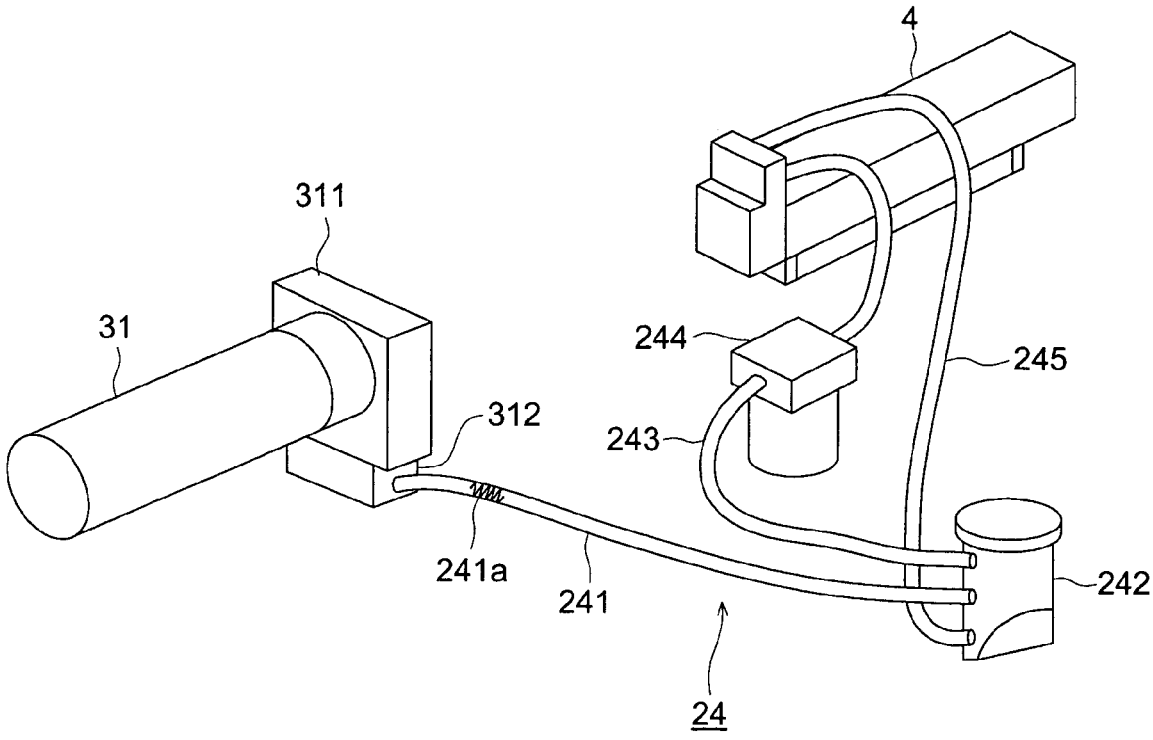
FIG. 2 is a drawing showing an example of a toner transport device utilized in an image forming method of this invention.

Toner transport device 24 of FIG. 1 is further detailed with reference to FIG. 2. FIG. 2 shows an example of a toner transport device.

The toner transport device of FIG. 2 is provided with toner container 31 and toner container holding section 311 which holds toner container 31. Further, it is also provided with toner bank section 312 in which toner ejected from toner container 31 is stored. Provided is a structure in which toner collected by cleaning device 7 from the residual unfixed toner on photosensitive element 1 is also fed into toner bank section 312. Further, the toner transport device is provided with toner transport tube element 241 which transports toner sent out from toner bank section 312, toner intermediate chamber 242 which is connected to the other end of toner transport tube element 241, air-pump motor 244 which is arranged in the path of toner transport tube 243 being a connection between toner intermediate chamber 242 and development device 4, and gas return tube 245 being a connection between development device 4 and toner intermediate chamber 242.

Toner supplied into toner bank section 312 is transported by toner transport tube element 241 to toner intermediate chamber 242. Toner transport tube element 241 incorporates freely rotatable transport coil 241*a* which is housed in the tube, and the toner in toner bank section 312 is transported into toner intermediate chamber 242 by rotating transport coil 241*a*, with a motor, not shown in the drawing. Toner intermediate chamber 242, air-pump motor 244 and development device 4 are connected to each other via toner transport tube 243. The toner, having been introduced by toner transport tube element 241 into toner intermediate chamber 242, is mixed with a gas returned from development device 4 through gas return tube 245, and is transported together with the gas to development device 4 via suction produced by air-pump motor 244. Gas return tube 245, to return gas from development device 4 to toner intermediate chamber 242, connects between development device 4 and toner supplying intermediate chamber 242, and gas circulates via toner intermediate chamber 242.

The aforesaid toner intermediate chamber is provided with a cylindrical or conical structure, and is preferably situated vertically so as to enable easier collect of toner aggregates or paper dust. Thereby, a constitution can be provided so that paper dust or toner granules precipitated to the bottom of the aforesaid toner intermediate chamber by utilizing gas spiraling gas flow.

Suitably, the toner intermediate chamber comprises a toner receiving section capable of receiving collected toner, a toner discharging section capable of discharging separated toner and a gas stream introducing port capable of introducing a gas stream into the intermediate chamber.

Suitably, at least a part of the toner receiving section is situation at the upper portion in the vertical direction of the gas introducing inlet.

More suitably, the toner intermediate chamber is equipped with a toner receiving port capable of receiving collected toner, a toner discharge port capable of discharging separated toner, a gas stream introducing inlet capable of introducing a gas stream into the aforesaid intermediate chamber, and at least a portion of said toner receiving port is situation at the upper portion in the vertical direction of said gas stream introducing section.

Suitably, the toner is transported out of the toner Intermediate chamber by use of a gas stream.

During the image forming operation in the image forming apparatus, toner is supplied by toner container 31, coil 241*a* and air-pump motor 244 being operated successively, as the amount of toner in development device 4 is consumed.

Figure 3:
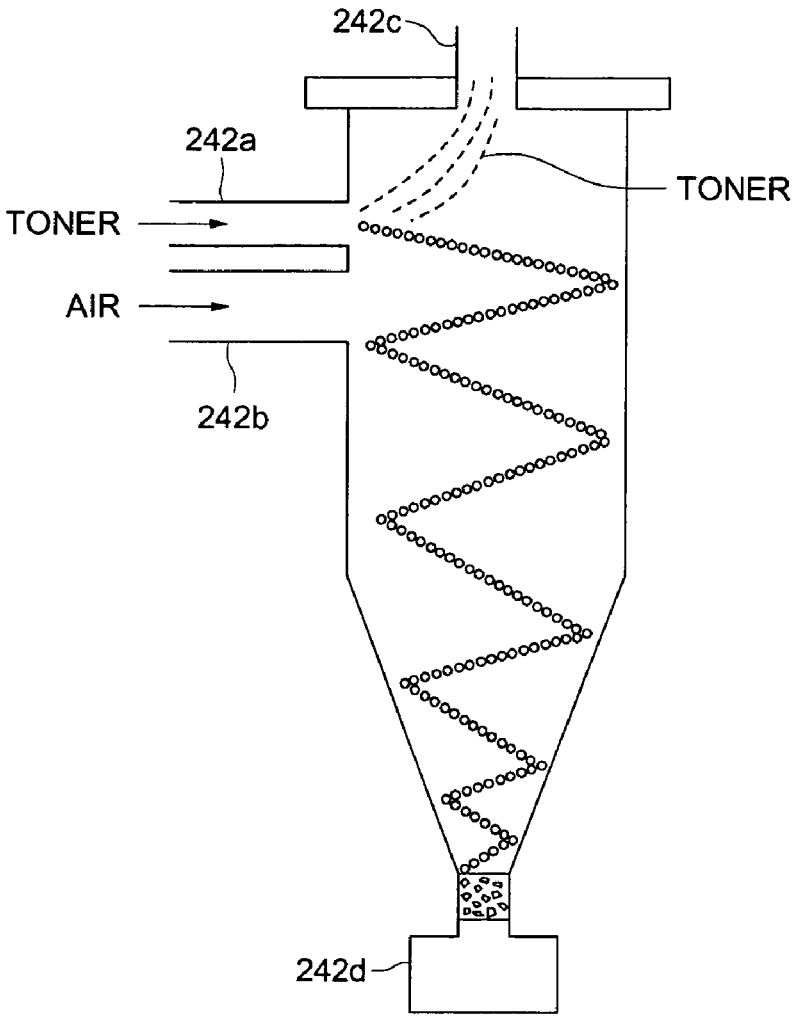
FIG. 3 is a drawing showing an example of a toner intermediate chamber of a toner transporting device utilized in an image forming method of this invention.

FIG. 3 shows a schematic constitution of toner intermediate chamber 242 utilized in this invention. Toner supplying toner intermediate chamber 242 is, for example, provided with a cylindrical housing having a diameter of approximately 30 mm and a height of approximately 80 mm. Toner supplying inlet 242*a* is provided at the upper portion of toner intermediate chamber 242 which accepts toner supply from toner bank section 312, so that toner is supplied from toner bank section 312 through toner transport tube element 241. Gas introducing inlet 242*b* is provided at the lower portion of toner intermediate chamber 242, gas is flown in from development device 4 via flexible gas return tube 245. Further, ejecting outlet 242*c* is provided above toner supplying inlet 242*a*, a mixture of toner and gas is ejected from there toward development device 4. Ejecting outlet 242*c* is connected to air-pump motor 244 and development 4 via flexible toner transport tube 243. Further, provided is paper dust drain 242*d* which stores paper dust or toner granules, having been separated, and it can be detached by a means of such as a screw.

When a signal to supply toner is sent to a control section, not shown in the drawing, during the operation of image formation, initially, transport coil 241*a* in toner transport tube element 241 is rotated by motor drive, not shown in the drawing, and toner is fed into toner intermediate chamber 242 through toner supplying inlet 242*a*. Nearly at the same time, air-pump motor 244 rotates to blow gas into the hollow of toner intermediate chamber 242 via gas introducing inlet 242*b*. Toner is agitated in the hollow toner intermediate chamber by the gas stream in toner intermediate chamber 242, and removed out through ejecting outlet 242*c*.

A separating means to efficiently separate paper dust or toner granules in toner intermediate chamber 242 which is incorporated in an image forming apparatus utilized in this invention, for example, preferably removes impurities such as paper dust and toner granules from toner by means of a cyclone provided in toner intermediate chamber 242, the spiraling stream of air generated by said cyclone. As a cyclone producing device usable in the toner intermediate chamber of this invention includes, for example, utilized can be one disclosed in JP-A No. 10-34022. Thereby, since impurities such as paper dust and toner granules in toner can be more efficiently removed compared to conventional methods, sufficiently satisfactory images without generated white or black spots can be formed, even when employing a recording medium which may produce excessive paper dust and the like. Further, resource saving and cost reduction can be achieved by using non-transferred toner.

Further, since toner having been stored in toner intermediate chamber 242 from toner bank section 312 in advance is supplied together with gas to development device 4 by use of air-pump motor 244 as a drive source, and only gas is made to circulate via toner intermediate chamber 242, a toner transport structure incorporating a recycle toner transport structure are made to be a compact constitution without causing toner leakage.

Next, toner utilized in this invention will be explained.

<Resins Prepared by Polyaddition Reaction or Polycondensation Reaction>

Toner utilized in this invention preferably comprises resins prepared by a polyaddition or polycondensation reaction. Furthermore preferable is a toner prepared through an aggregation process of resin particles in a water-based medium utilizing a dispersion in which said resin particles are dispersed in a water-based medium. Such resins include, for example, polyester resin, amorphous polyester resin, polyurethane resin, epoxy resin, polyol resin and the like.

Further, among polyester resins amorphous polyester resin is preferably utilized. These toners are easily separated from impurities such as paper dust and toner granules due to a narrow particle size distribution, as well as efficiently separated without causing electrostatic aggregation due to the order in the triboelectric series being near that of the toner and of a minus charge.

Herein, "amorphous polyester" is defined that polyester molecules, a clear crystal structure which is not recognized by means of X-ray diffraction, occupy at least 50 mol % of the total component molecules. More specifically, polyester molecules, which have a crystallization degree of less than 0.1% occupy not less than 50% of the total component molecules, are known as amorphous polyester.

Further, in this invention, the crystallization degree can be measured by density, heat of fusion or X-ray diffraction, NMR (nuclear magnetic resonance spectra), and is represented by a weight ratio of the crystalline portion (as a percentage).

<Polyester Resin>

Polyester resin will now be explained.

Dihydric alcohol monomers utilized in synthesis of polyester resin include, for example, etherified bisphenols such as polyoxypropylene(2,2)-2,2-bis(4-hydroxyphenyl)propane, polyoxypropylene(3,3)-2,2-bis(4-hydroxyphenyl)propane, polyoxyethylene(2,0)-bis(4-hydroxyphenyl)propane, polyoxypropylene(2,0)-polyoxyethylene(2,0)-2,2-bis(4-hydroxyphenyl)propane and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, 1,4-butenediol, neopentyl glycol, 1,5-pentanediol, 1,6-hexanediol, 1,4-cyclohexane dimethanol, dipropylene glycol, polyethylene glycol, polypropylene glycol, polytetramethylene glycol, bisphenol A, hydrogenated bisphenol A, etc.

Dibasic carboxyl acid monomers utilized in synthesis of polyester resin include, for example, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecyl succinic acid, n-dodesenyl succinic acid, isododecyl succinic acid, isododecenyl succinic acid, n-octyl succinic acid, n-octenyl succinic acid, n-octenyl succinic acid and acid anhydrides or lower alkyl esters thereof.

Further, in this invention, utilized can be polyhydric alcohol monomers and polybasid carboxylic acid monomers.

Tri- or higher-hydric alcohol monomers include, for example, sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Tri- or higher-basic carboxylic acid monomers include, for example, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra(methylenecarboxyl)methane, 1,2,7,8-octane tetracarboxylic acid, pyromellitic acid, empole trimer acid, and acid anhydrides or lower alkylesters thereof.

Further, the polar group of a polyester polymer end is blocked and a mono-functional monomer may be introduced in the polyester with respect to improving environmental stability of static charge buildup characteristics. As a mono-functional monomer, utilized may be monocarboxylic acids such as benzoic acid, chlorobenzoic acid, bromobenzoic acid, parahydroxybenzoic acid, sulfobenzoic acid mono-ammonium salt, sulfobenzoic acid mono-sodium salt, cyclohexyl aminocarbonyl benzoic acid, n-dodecylaminocarbonyl benzoic acid, tertiary-butylbenzoic acid, naphthalene carboxylic acid, 4-methylbenzoic acid, 3-methylbenzoic acid, sarlicylic acid, thiosarcylic acid, phenyl acetate, acetic acid, propionic acid, butyric acid, isobutyric acid, octane carboxylic acid, lauric acid, stearylic acid and lower alkyl esters thereof; or monoalcohols such as aliphatic alcohol, aromatic alcohol and alicyclic alcohol.

<Amorphos Polyester Resin>

Amorphous polyester resin will now be explained.

Amorphous polyester resins utilized in this invention are preferably those comprising a molecular structure known as urethane modified polyester which is provided with a urethane bond and has been modified. In the following paragraphs, urethane polyester (i) (polyester modified with a urethane bond) will be explained.

(Urethane Modified Polyester)

Polyester modified with a urethane bond (i) includes such as reaction products of a polyester prepolymer (A) provided with an isocyanate group and an amine series (B). Polyester prepolymer (A) provided with an isocyanate group includes polyester which is prepared by polycondensation of the aforesaid polyhydric carboxylic acid series with a polyhydric alcohol series, and further provided with an active hydrogen group further reacted with a polyisocyanate. The active hydrogen group of the aforesaid polyester includes a hydroxyl group (an alcoholic hydroxyl group and a phenolic hydroxyl group), an amino group, a carboxyl group and a mercapto group, but preferable among these is the alcoholic hydroxyl group.

Polyisocyanate includes aliphatic polyisocyanate (such as tetramethylene diisocyanate, hexamethylene diisocyanate and 2,6-diisocyanate methylcaproate); alicyclic polyisocyanate (such as isophorone diisocyanate and cyclohexylmethane diisocyanate); aromatic diisocyanate (such as tolylene diisocyanate and diphenylmethane diisocyanate); aromatic aliphatic diisocyanate (such as α, α, α', α'-tetramethylxylene diisocyanate); an isocyanurate series; the aforesaid polyisocyanate having been blocked with such as a phenol derivative or caprolactam; as well as combinations of two or more types thereof. The polyisocyanate ratio is generally 5/1-1/1, preferably 4/1-1.2/1 and furthermore preferably 2.5/1-1.5/1, based on an equivalent ratio [NCO]/[OH] of an isocyanate group [CNO] to a hydroxyl group [OH] of polyester provided with a hydroxyl group.

The fixing property at low temperature is deteriorated when [NCO]/[OH] is over 5. The urethane content in modified polyester is reduced and resistance to hot offset is degraded when the mole ratio of [NCO] is less than 1. The content of a component constituting polyisocyanate in a prepolymer, the ending terminal of which is provided with an isocyanate group (A), is generally 0.5-40 weight %, preferably 1-30 weight % and more preferably 2-20 weight %.

The number of an isocyanate group contained per one molecule of a prepolymer provided with an isocyanate group (A) is generally at least 1, preferably 1.5-3 and more preferably 1.8-2.5, based on average numbers.

An amine series (B) includes such amines as diamine (B1), tri- or higher- polyamine (B2), aminoalcohol (B3), aminomercaptan (B4), amino acid (B5), and B1-B5 amino groups which are blocked (B6). Diamine (B1) includes aromatic diamines (such as phenylenediamine, diethyltoluenediamine and 4,4'-diaminodiphenylmethane); alicyclic diamines (such as 4,4'-diamino-3,3'-dimethylcyclohexylmethane, diamine cyclohexane and isophorone diamine); and aliphatic diamines (such as ethylenediamine, tetramethylenediamine and hexamethylenediamine). Polyamines not less than trivalent (B2) include such as diethylenetriamine and triethylenetetramine. Aminoalcohols (B3) include compounds such as ethanolamine and hydroxyethylaniline. Aminomercaptans (B4) include such as aminoethylmercaptan and aminopropylmercaptan. Amino acids (B5) include aminopropionic acid and aminocapronic acid. B1-B5 amino groups which are blocked (B6) include ketimine compounds and oxazoline compounds prepared from an amine series and a ketone series (such as acetone, methyl ethyl ketone and methyl isobutyl ketone) of aforesaid B1 to B5. Among these amine series (B), preferable is B1 and a mixture of B1 with a small amount of B2.

Further, the molecular weight of urethane modified polyester can be controlled by appropriately utilizing an extension terminator. An extension terminator includes such as monoamines (such as diethylamine, dibutylamine, butyl amine and laurylamine) and blocked compounds thereof (ketimine compounds).

The ratio of an amine series (B) is generally 1/2-2/1, preferably 1.5/1-1/1.5 and more preferably 1.2/1-1/1.2, based on the equivalent ratio of an isocyanate group [NCO] in prepolymer (A) provided with an isocyanate group to an amino group [NHx] in amine series (B): [NCO]/[NHx].

Urethane modified polyester (i) is prepared by means of a one-shot method or a prepolymer method. The weight average molecular weight of urethane modified polyester (i) is generally at least 10,000, preferably 20,000-10,000,000 and more preferably 30,000-1,000,000. Resistance to hot offset is deteriorated when the average molecular weight is less than 10,000. The number average molecular weight of urethane polyester is not specifically limited when non-modified polyester (ii) is utilized, and may be any number average molecular weight which can be easily be obtained to obtain the aforesaid weight average molecular weight. The number average molecular weight is generally at most 20,000, preferably 1,000-10,000 and more preferably 2,000-8,000, when (i) is utilized alone. A low temperature fixing property and glossiness in the case of being utilized in a full-color apparatus are deteriorated, when the number average molecular weight is over 20,000.

In this invention, polyester resin not being modified with a urethane bond (ii) and polyester modified with such as a urethane bond (i) may be also utilized in combination as a binder resin. The low temperature fixing property and glossiness in the case of being employed in a full color apparatus are improved by incorporation of (ii), resulting in being superior to utilization of (i) alone. As (ii), listed are polycondensation compounds of polyol (1) and polycarboxylic acid (2) similar to the aforesaid polyester component. Preferable compounds are also those similar to (i). Further, (ii) may be not only amorphous polyesters but also those modified with a chemical bond other than a urethane bond; for example, they may be modified with a urethane bond. (i) and (ii) are preferably at least partly dissolved in each other, with respect to achieving a low temperature fixing property and resistance to hot offset. Therefore, polyester components of (i) and (ii) preferably have a similar composition. In the case of incorporating (ii), the weight ratio of (i) to (ii) is generally 5/95-80/20, preferably 5/95-30/70, more preferably 5/95-25/75 and specifically preferably 5/95-20/80. It is disadvantageous with respect to compatibility of tropical heat storage stability and a low temperature fixing property, and in addition resistance to hot offset is deteriorated, when the weight ratio of (i) is less than 5%. A peak molecular weight of (ii) is generally 1,000-30,000, preferably 1,500-10,000 and more preferably 2,000-8,000. Tropical heat storage stability is deteriorated when it is less than 1,000, and a low temperature fixing property is deteriorated when it is over 10,000. The hydroxyl value of (i) is preferably at least 5, more preferably 10-120 and specifically preferably 20-80. It is disadvantageous with respect to compatibility of tropical heat storage stability and a low temperature fixing property when the hydroxyl value is less than 5. The acid value of (ii) is generally 1-30 and preferably 5-20. There is a tendency to generate a negative charging property by providing an acid value.

<Polyol Resin, Epoxy Resin>

Polyol resin and epoxy resin utilized in this invention will now be explained.

Various types of resin may be utilized as polyol resin, however, the following are specifically preferred in this invention. Preferably utilized are polyols prepared by reacting epoxy resin, an alkyleneoxide adduct of dihydric phenol or glycidyl ether thereof, with a compound having at least two reactive hydrogen atoms which react with an epoxy group in the molecule. Further, specifically preferable epoxy resins are at least two types of bisphenol A type epoxy resins having different number average molecular weights. These polyols are effective for providing excellent glossiness and transparency as well as resistance to offset.

Epoxy resins utilized in this invention are preferably those prepared by combining bisphenols such as bisphenol A and bisphenol F with epichlorohydrine. Epoxy resin is preferably comprised of at least two types of bisphenol A type epoxy resins having different number average molecular weights; the number average molecular weight of the lower molecular weight component being 360-2,000 and the number average molecular weight of the higher molecular weight component being 3,000-10,000 which achieve stable fixing characteristics and glossiness. Further, the lower molecular weight component is preferably contained in the range of 20-50 weight %, and the higher molecular weight component is preferably contained in the range of 5-40 weight %. When the content of the low molecular weight component is too great or the molecular weight is lower than 360, there is a possibility of too much glossiness in addition to deterioration of storage stability. Further, when the content of the high molecular weight component is too much or the molecular weight is higher than 10,000, there is possibility of too little glossiness in addition to deterioration of the fixing property.

As compounds utilized in this invention, that is, as alkyleneoxide adducts of dihydric phenols, listed are the following. Listed are reaction products of ethyleneoxide, propyleneoxide, butyleneoxide and mixtures thereof, with bisphenols such as bisphenol A and bisphenol F. The prepared adducts may be glycidylized by use of epichlorohydrine or methylepichlorohydrine. Specifically, preferred are diglycidyl ether of alkyleneoxide adducts of bisphenol A, represented by following general formula (VI).

General Formula (VI)

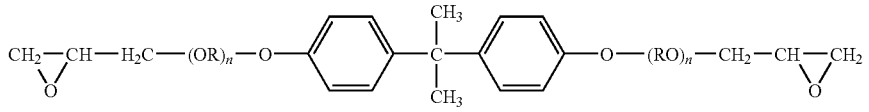

(wherein, R is —$CH_2$—$CH_2$—,

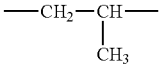

or

—$CH_2$—$CH_2$—$CH_2$—; n and m are numbers of a repeating unit and being at least 1, and "n+m" is 2-6.) Further, an alkyleneoxide adduct of dihydric phenol or glycidyl ether thereof is preferably contained at 10-40 weight % based on polyol resin. Drawbacks such as increase of curling may be caused when the content is too small, while there is a possibility of too much glossiness as well as deterioration of storage stability, when n+m≧7 or the content is too high. Compounds having one reactive hydrogen atom which reacts with an epoxy group in the molecule are a monohydric phenol series, a secondary amine series and a carboxylic acid series. As a monohydric phenol series, exemplified are the following. Listed are such as phenol, cresol, isopropylphenol, aminophenol, nonylphenol, dodecylphenol, xylenol and p-cumylphenol. As a secondary amine series, listed are diethylamine, diopropylamine, dibutylamine, N-methyl (ethyl)piperazine and piperidine. Further, as carboxylic acid series, listed are propionic acid and caproic acid.

To prepare polyol resin of this invention provided with an epoxy resin portion and an alkyleneoxide portion in the main chain, various combinations of raw materials are possible. For example, it can be prepared by reacting epoxy resin having glycidyl groups on both ends and an alkyleneoxide adduct of a dihydric phenol having glycidyl groups on both ends with dihalide diisocyanate, diamine diol polyhydric phenol or dicarboxylic acid. Among them with respect to reaction stability preferred is to react a dihydric phenol. Further, it is also preferable to utilize a polyphenol series and a polybasic carboxylic acid series together with dihydric phenol. Herein, the amount of a polyhydric phenol series or a polybasic carboxylic acid series is generally at most 15% but preferably at most 10% based on the total amount.

A compound provided with two or more reactive hydrogen atoms which react with an epoxy group in the molecule includes a dihydric phenol series, a polyhydric phenol series, and a polybasic carboxylic acid series. As dihydric phenol, listed are bisphenols such as bisphenol A and bisphenol F. As a polyhydric phenol series, exemplified are an orthocresol novolak series, a phenol novolak series, tris(4-hydroxyphenyl)methane and 1-[α-methyl-α-(4-hydroxyphenyl)ethyl] benzene. As a polybasic carboxylic acid series, exemplified are maronic acid, succinic acid, glutaric acid, adipic acid, maleic acid, fumaric acid, phthalic acid, terephthalic acid, trimellitic acid and trimellitic acid anhydride. Further, these polyester resins or polyol resins preferably provided with no cross-linking or at least weak cross-linking (being at most 5% of the THF insoluble portion), because transparency or glossiness are barely obtained when it is provided with a high cross-linking density.

<Preparation Method of Dispersion in Which Resin Particles According to This Invention are Dispersed in a Water-Based Medium>

A method to prepare a dispersion in which resin particles of this invention are dispersed in a water-based medium is not specifically limited, and includes the following methods.

(1) In the case of the resin particles comprising polyadition or polycondensation resin of such as polyester resin and polyol resin, the following method can be employed.

(a) A method in which phase transition emulsification is preformed after an appropriate emulsifier is dissolved in a precursor (such as a monomer or an oligomer) or in a solvent solution thereof (being preferably a liquid or may be a solid liquefied by heat).

(2) A method in which resin particles are formed by a polymerization reaction such as a suspension polymerization method, an emulsion polymerization method, a seed polymerization method or a dispersion polymerization method employing a monomer as a starting material, and a water-based dispersion of the obtained resin particles is directly prepared.

(3) A method in which the resin having been prepared by a polymerization reaction (being any type of a polymerization reaction such as addition polymerization, ring-opening polymerization, polyaddition, addition condensation, or condensation polymerization) in advance is dispersed by means of the following methods.

(a) A method in which after resin particles are prepared by grinding the resin prepared above by use of a grinder, such as a mechanical rotating type or a jet type, followed by classification, said resin particles are dispersed in water incorporating an appropriate dispersing agent.

(b) A method in which after resin particles are prepared by spraying the resin solution, comprising resin prepared above being dissolved in a solvent, as a mist, said resin particles are dispersed in water incorporating an appropriate dispersing agent.

(c) A method in which after resin particles are prepared by adding a poor solvent into a resin solution comprising the resin prepared above is dissolved in a solvent, or resin particles are precipitated by cooling the resin solution in which the resins have been dissolved by heating followed by removing the solvent, said resin particles are dispersed in water incorporating an appropriate dispersing agent.

(d) A method in which a resin solution comprising the resin prepared above, having been dissolved in a solvent is dispersed in a water-based medium incorporating an appropriate dispersing agent, from which the solvent is removed by a means such as heat or reduced pressure.

(e) A method in which after dissolving an appropriate emulsifier in a resin solution comprising the resin prepared above having been dissolved in a solvent, phase transition is performed by adding water. As emulsifiers or dispersants incorporated in the above methods, utilized can be commonly known surfactants (S) and water-soluble polymers (T). Further, a solvent (U) and a plasticizer (V) may be utilized in combination as a supplement for emulsification or dispersion. Specific examples include those disclosed in columns 0036-0062 of JP-A No. 2002-284881.

<Colorants>

Colorants employed in this invention will now be explained.

As a colorant employed in the toner utilized in this invention, utilizable can be all the commonly known dyes or pigments, and specifically utilized can be carbon black, Nigrosine Dye, iton black, Naphthol Yellow, Hansa Yellow (10G, 5G, G), Cadmium Yellow, yellow ferric oxide, yellow ochre, Titan Yellow, Polyazo Yellow, Oil Yellow, Hansa Yellow (GR, A RN, R), Pigment Yellow L, Permanent Yellow (NCG), Vulcan Fast Yellow (5G, R), Tartrazine Lake, Quinoline Yellow Lake, Anthrasan Yellow BGL, Isoindolinone Yellow, red ion oxide, Permanent Red 4R, Para Red, Fire Red, Parachloro Orthonitroaniline Red, Lithol Fast Scarlet G, Brilliant Fast Scarlet, Brilliant Carmine BS, Parmanent Red (F2R, F4R, FRL, FRLL, F4RH), Fast Scarlet VD, Vulcan Fast Rubin B, Brilliant Scarlet G, Lithol Rubin GX, Permanent Red F5R, Brilliant Carmine 6B, Pigment Scarlet 3B, Bordeaue 5B, Toluidine Maroon, Permanent Bordeaue F2K, Helio Bordeaue BL, Bardeaue 10B, Bon Maroon Light, Bon Maroon Medium, eosine lake, Rhodamine Lake B, Rhodamine Lake Y, Alizaline Lake, Thioindigo Red B, Thioindigo Maroon, Oil Red, Quinacridone Red, Pyrazolone Red, Polyazo Red, Chrome Vermillion, Benzidine Orange, Perinone Orange, Oil Orange, cobalt blue, cerulean blue, Alkali Blue Lake, Peacock Blue Lake, Victoria Blue Lake, Metal-free Phthalocyanine Blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxane violt, Anthraquinone Violet, chrome green, zinc green, viridian, emerald green, Pigment Green B, Naphthol Green B, Green Gold, Acid Green Lake, Malachite Green Lake, Phthalocyanine Green, Anthraquinone Green, titanium oxide, Lithopone, and mixtures thereof. The content is preferably 1-20 weight parts per 100 weight parts of resin (binder resin).

<Releasing Agent (Also Referred to as Wax)>

Releasing agents utilized in this invention will now be explained.

In this invention, wax is preferably incorporated in toner to provide a developer with a suitable releasing property. Said wax preferably has a melting point of 40-150° C. but specifically preferably 50-110° C.

It has been proved that excellent fixing property is obtained even when the fixing temperature is set low, as well as superior resistance to offset and durability are obtained by providing a melting point in the range described above.

Herein, the melting point of wax can be determined by means of a differential scanning thermal measurement method (DSC). That is, the peak melting value is defined as the melting point when a sample of a few mg is heated at a constant temperature increasing rate, for example 10° C./min.

As a releasing agent (wax) usable in this invention, utilized for example may be paraffin wax, micro wax, rice wax, aliphatic acid amide type wax, aliphatic acid type wax, an aliphatic monoketone series wax, aliphatic acid metal salt type wax, aliphatic acid ester type wax, partly saponificated aliphatic acid ester type wax, silicone wax, higher alcohol wax and carnauba wax.

In toner utilized in this invention, specifically preferred are ester type compounds represented by the following formula.

$$R_1—(OCO—R_2)_n$$

wherein, n is an integer of 1-4, preferably 2-4, more preferably 3-4 but most preferably 4. $R_1$ and $R_2$ each represent a hydrocarbon group which may have a substituent. $R_1$ has a carbon number of 1-40, preferably 1-20 and furthermore preferably 2-5. $R_2$ has generally a carbon number of 1-40, preferably 16-30 and more preferably 18-26.

Further, in this invention, toner particles may be formed by employing a dispersion, comprising wax having been stirred while being heated in a water-based medium incorporating a surfactant or a dispersant described below. In this case, it is possible that a wax emulsion comprising wax having been emulsified is added while being aggregated together with a colorant dispersion solution at the time of aggregating resin particles.

<Charge Control Agent>

A charge control agent utilized in this invention will now be explained.

Toner utilized in this invention may appropriately contain a charge control agent. As a charge control agent, utilized can be all those commonly known, for example, listed are fluorine type surfactants, salicylic acid metal salts and metal salts of salicylic acid derivatives, and, specifically, listed are Bontrone 03 being a nigrosine type dye, Bontrone P-51 being a quaternary ammonium salt, Bontrone S-34 being an azo type metal complex salt compound, E-82 being an oxynaphthoic acid type metal complex, E-84 being a salicylic acid type metal complex, E-89 being a phenol type condensation compound (all above being manufactured by Orient Chemical Industrial Co., Ltd.), TP-302, TP-415 being a quaternary ammonium salt molybdenum complex (being manufactured by Hodogaya Chemical Co., Ltd.), Copy Charge PSY VP2038 being a quaternary ammonium salt, Copy Blue PR being a triphenylmethane derivative, Copy Charge NEGVP2036 and Copy Charge NX VP434 being a quaternary ammonium salt (all above being manufactured by Hoechst Corp.), LRA-901, LR-147 being a boron complex (being manufactured by Nippon Caritte Co., Ltd.), in addition to polymer compounds provided with a functional group such as a sulfonate group, a carboxyl group or a quaternary ammonium salt. Among these, preferable is an azo type metal complex salt compound, and preferably utilized are, for example, those disclosed in sections 0009 to 0012 of JP-A No. 2002-351150.

In this invention, since the usage amount of a charge control agent is determined according to the type of binder resin, presence of an additive appropriately utilized and a toner preparation method including a dispersion method, the usage amount is not limited unequivocally, however, is preferably in the range of 0.1-2 weight parts and more preferably 0.2-5 weight parts per 100 weight parts of the binder resin.

In this invention, it is preferred that a charge control agent is added in the vicinity of the toner particle surface. That is, it is possible to effectively provide the toner particles a charging property by adding the charge control agent in the vicinity of the toner particle surface, as well as to secure fluidity of toner by adding a charge control agent on the toner particle surface while not exposed.

Specific incorporating methods include, for example, a method in which controlled is the addition amount of a charge control agent to the resin particles constituting toner particles. That is, listed are a method in which a large amount of a charge control agent having been added to resin particles constituting the vicinity of toner particles followed by aggregation of resin particles being performed so as to form the toner particle surface with resin particles without a charge control agent having been added, and a method in which after resin particles incorporating a charge control agent having been aggregated followed by encapsulation of the aggregated particle surface with a resin component without a charge control agent.

As the addition method into resin particles, it is preferred that a charge control agent is kneaded into a binder resin and the dispersion diameter is controlled, in addition to this, it may be added in a water phase, followed by being incorporated in toner during the aggregation process or the drying process, in the case of being eluted or isolated to a water phase from an oil phase while being emulsified in a water-based medium.

<External Additives>

External additives such as silica micro-particles or titanium micro-particles utilized in this invention will now be explained.

As external additives to assist fluidity, developability or charging property of toner particles prepared in this invention, inorganic micro-particles are preferably utilized. The primary particle diameter is preferably from 5-2000 nm and specifically preferably 5- to 200 nm. The specific surface area based on the BET method is preferably 20-500 $m^2/g$. The usage ratio of the inorganic micro-particles is preferably 0.01-5 weight % and specifically preferably 0.01-2.0 weight % based on the toner. Specific examples of inorganic micro-particles include, for example, silica, alumina, titanium oxide, barium titanate, magnesium titanate, calcium titanate, strontium titanate, zinc oxide, tin oxide, siliceous sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

Of these, preferable are external additives comprising silica or titanium micro-particles having a primary particle diameter of 50-200 nm, with respect to supporting the glide fixing property while maintaining the charging property and the transferring property in addition to the cleaning property.

Herein, the primary particle diameter can be measured by use of TEM (transparent type electronmicroscopy) or FE-SEM (field emission type scanning electronmicroscope). Further, when particles are of a needle-form or a polyhedral particle, the longer dimension of said particle is designated as the primary particle diameter.

Other than these, listed are polymer type micro-particles, for example, polystyrene, methacryl acid ester, acrylic acid ester copolymers, a polycondensation type such as silicone, benzoguanamine and nylon; as well as polymer particles prepared from thermally curable resin, which are prepared by soap-free emulsion polymerization, suspension polymerization or dispersion polymerization.

Such a fluidity providing agent can be subjected to a surface treatment to increase hydrohobicity and prevent deterioration of fluid characteristics and charging characteristics even under high humidity. For example, listed as a preferable surface processing agent can be such as a silane coupling agent, a silylization agent, a silane coupling agent having an alkylfluoride group, an organotitanate type coupling agent, an aluminum type coupling agent, silicone oil and modified silicon oil.

A cleaning property improving agent, to remove the developer remaining on a photosensitive element or on a primary transfer medium after a transfer process, includes, for example, aliphatic acid metal salts such as zinc stearate, calcium stearate and stearic acid, polymer micro-particles prepared by soap-free emulsion polymerization such as polymethacrylate micro-particles and polystyrene micro-particles. Polymer micro-particles preferably have a relatively narrow particle size distribution and a primary particle diameter of preferably 0.01-1 am.

<Aggregation Method of Resin Particles>

Explained now will be an aggregation method of resin particles of this invention in a water-based medium.

(Manufacturing Method)

Resin or other toner materials of this invention are dissolved and dispersed in an organic solvent by means of such as stirring with a common impeller, while being appropriately heated, a ball mill, a sand mill or a homogenizer, then the system is emulsified and dispersed in a water-based medium. Employed for this process can be an emulsifying device such as HOMO MIXER (produced by Tokusyu-Kika Co., Ltd.), EBARA MILDER (produced by Ebara Corp.) and CLEAR MIX (produced by M-Technique Co., Ltd.).

At this time, the desired diameter and size distribution of the droplets can be achieved by controlling the concentration of the emulsifier, the solid concentration in the organic solvent, the ratio of a water-based medium to an oil phase in which the solid is dispersed, the rotation rate and duration during emulsifying dispersion. It is preferable to perform emulsifying dispersion down to 1/2-1/100 of the desired toner particle diameter. The weight ratio of the solid to the organic solvent is suitably selected between 1/10 and 1/1, and the weight ratio of the water-based medium to the oil phase in which the solid is dispersed is suitably between 10/1 and 1/1, however, they may of course be other than in these ranges.

Organic solvents to dissolve and disperse the solidified toner component are not specifically limited provided they are insoluble, slightly soluble or partly soluble in water and dissolving the resin constituting the solid and the resin used while mixing and kneading, and utilized can be, for example, toluene, xylene, benzene, carbon tetrachloride, methyl acetate, ethyl acetate, methyl ethyl ketone and methyl isobutyl ketone, alone or in combinations of two or more types thereof. Particularly preferable are aromatic type solvents such as toluene and xylene, as well as organic acid esters.

Dispersants to emulsify and disperse the oil phase, containing water in which the toner component is dispersed, down to the desired particle diameter include anionic surfactants such as alkyl benzene sulfonate, α-olefin sulfonate and phosphoric acid ester; as well as alkyl sulfonic acid ester.

Further, dispersed droplets may be stabilized by a polymer type protective colloid. For example, utilizable may be an acid series such as acrylic acid, methacrylic acid, α-cyanoacrylic acid, α-cyanomethacrylic acid, itaconic acid, crotonic acid, fumaric acid, maleic acid and maleic acid anhydride; (meth)acryl type monomers containing a hydroxyl group such as α-hydroxyethyl acrylate, β-hydroxyethyl ethacrylate, β-hydroxypropyl acrylate, β-hydroxypropyl methacrylate, γ-hydroxypropyl acrylate, γ-hydroxypropyl methacrylate, 3-chloro2-hydroxypropyl acrylate, 3-chloro2-hydroxypropyl methacrylate, dithyleneglycol monoacrylic acid ester, dithyleneglycol monomethacrylic acid ester, glycerin monoacrylic acid ester, glycerin monomethacrylic acid ester, N-methylolacrylamide and N-methylolmethacrylamide; vinylalcohol or an ether series with vinylalcohol such as vinylmethyl ether, vinylethyl ether and vinylpropyl ether; an ester series of vinylalcohol and a compound having a carboxyl group such as vinyl acetate, vinyl propionate and vinyl butyrate; acrylamide, methacrylamide, diacetone acrylamide and methylol compound thereof; an acid chloride series such as acrylic acid chloride and methacrylic acid chloride; homopolymers or copolymers of those having a nitrogen atom or a hetrocyclic ring thereof such as vinylpyridine, vinylpyrrolidone, vinylimidazole and ethyleneimine; a polyoxyethylene type such as polyoxyethylene, polyoxypropylene, polyoxyehtylene alkylamide, polyoxypropylene alkylamide, polyoxyethylene nonylphenyl ether, polyoxyethylene laurylphenyl ether, polyoxyethylene stearylphenyl ester and polyoxyethylene nonylphenyl ester; and a cellulose series such as methyl cellulose, hydroxyethyl cellulose and hydroxypropyl cellulose.

To remove the organic solvent from an emulsified dispersion, employable may be a method in which the whole system is gradually heated to completely remove the organic solvent from droplets by evaporation. In that case, it is preferable to perform the operation under reduced pressure so that a lower heating temperature can be employed, so that wax and other toner constituting components are prevented from dissolving in the organic solvent or an emulsified dispersion is kept from extraordinary aggregation, association or unification by heating. The removal process of the organic solvent may be performed either before the aggregation process or after the same. However, it is preferable to perform removal of the organic solvent before the aggregation process, because the resin particle dispersion stabilizes and control of aggregation is easier as well as that the particle size distribution becomes narrower.

As another treating method of the system dissolved in an organic solvent, it is also possible that an emulsified dispersion is sprayed in a dry environment to completely remove water-insoluble organic solvents from droplets to prepare toner micro-particles, as well as removal of a water-based dispersant by evaporation. As a dry environment in which an emulsifying dispersion is sprayed, utilized may be heated gases comprising air, nitrogen, oxygen or a combustible gas, in particular, generally utilized are various types of gas streams heated at a temperature higher than the boiling point of the solvent having the maximum boiling point. Reasonably targeted quality can be obtained by short duration processing using a spray drier, a belt drier or a rotary kiln.

As an aggregation method, when micro-particles are dispersed in water while carrying a charge, employed can be a method in which such particles can be aggregated by compressing an electric double layer with the addition of an electrolyte and the like; aggregation is caused by adsorbing a water-soluble polymer having a high molecular weight onto the particles; micro-particles may be aggregated by incorporating a substance having an opposite charge of the surfactant or dispersant utilized to neutralize the charge on the micro particle surface; or aggregation may be caused due to weakening dispersion stability by varying the counter ion of the absorbed surfactant or dispersant or by incorporating another substance into the water-based medium.

Simultaneously, it is possible to provide toner during manufacture with a mold-releasing property while fixing and strengthen the triboelectric charge by aggregating it with the aforesaid wax emulsion or resin micro-particles having a polar group, is also possible to prevent blocking of toner during high temperature storage by arranging resin micro-particles having a high glass transition temperature, at a position relatively on the exterior of the toner.

As a coagulator employed as an electrolyte may be general inorganic or organic water-soluble salts represented by, for example such as sodium sulfate, ammonium sulfate, magnesium sulfate, sodium phosphate, sodium dihydrogenphosphate, disodium hydrogenphosphate, ammonium chloride, calcium chloride, cobalt chloride, strontium chloride, cesium chloride, barium chloride, nickel chloride, magnesium chloride, rubidium chloride, sodium chloride, sodium acetate, ammonium acetate and sodium benzoate. The concentration of these electrolytes is preferably 0.01-2.0 mol/l, more preferably 0.1-1.0 and most preferably 0.2-0.8, in the case of utilizing a monovalent electrolyte. Further, the addition amount may be less than the above if utilizing a polyvalent electrolyte. Preferable are those exemplified above in the case of a surfactant, while particularly suitable are polymers having an ultra-high molecular weight, among those forming a polymer protective colloid in the case of a polymer type aggregator. Further, as a substance to cause aggregation by incorporation in a water-based medium to weaken dispersion stability, utilized may be water-soluble organic compounds such as ethanol, butanol, isopropanol, ethylcellosolve, butylcellosolve, dioxane, tetrahydrofuran, acetone and methyl ethyl ketone.

Further, the toner shape can be controlled by heating the dispersion after aggregation to make micro-particles fuse adhered to each other. Toner tends to be a spherical form due to surface tension, however, the particle shape may be adjusted arbitrarily from a sphere to an amorphous form by heating and/or the presence of an organic solvent.

It is possible that a dispersion of aggregated particles can be sprayed in a dry atmosphere to completely eliminate any water-insoluble organic solvent remaining on the aggregated particles resulting in formation of toner micro-particles, as well as to remove a water-based dispersant by evaporation. As a dry environment in which an emulsified dispersion is sprayed, utilizable are heated gases comprising air, nitrogen, oxygen or a combustible gas, in particular, generally utilized are various types of gas streams, heated to a temperature higher than the boiling point of the solvent having the maximum boiling point. Reasonably targeted quality can be obtained by short duration processing using a spray drier, a belt drier or a rotary kiln. Dispersants and emulsifiers utilized can be almost totally removed by performing solid-liquid separation and adding washing water before drying and repeating redispersion (reslurry) before drying.

It is possible to prevent foreign particles to be released from the surface of complex particles, by obtained toner powder having been dried while mixed with an external additive, or by solidification at the surface with a mechanical force applied to the mixed powder.

Specific means include a method in which a mechanical impact is applied on a mixed substance by use of a fan rotating at a high RPM, and a method in which a mixed substance is blown into a high-speed gas stream to be accelerated, whereby particles are collided each other or complex particles are collided against an appropriate collision plate are collided. Such apparatus includes an Ongu Mill (produced by Hosokawa Micron Co., Ltd.), a HENSCHEL MIXER (produced by Mitsui Mining Co., Ltd.), a HYBRIDIZATION SYSTEM (produced by Nara Kikai Seisakusho Co., Ltd.) and a CRIPTRON SYSTEM (produced by Kawasaki Heavy Industries, Ltd.).

<Degree of Circularity of Toner Particles>

Toner particles utilized in this invention has an average circularity of 0.94-0.99 and an average equivalent circle diameter of 2.6-7.4 μm. The average circularity of toner particles is preferably 0.95-0.98 and the average equivalent circle diameter is preferably 3.4-6.6 μm. By utilizing such toner, it is possible to more efficiently perform separation of normal toner from impurities such as paper dust, broken toner particles, aggregated toner and separated external additives contained in the toner, when passing toner containing collected non-transferred toner through an toner intermediate chamber provided with a structure to introduce toner from the top and to eject a gas from the bottom. Thereby, since impurities in toner can be eliminated more efficiently compared to conventional toner, satisfactory images containing no white or black spots can be formed even when employing a recording medium generating excessive paper dust. Further, resource saving and cost reduction have been achieved by reusing unfixed toner. The average circularity is a value determined by the following equation when at least 2,000 toner particles having a particle diameter of not less than 1 μm.

Circularity=(circumferential length of an equivalent circle)/(circumferential length of a projected toner particle image)=$2\pi\times$(the projected area of a particle/$\pi)^{1/2}$/(the circumferential length of a projected toner particle image)

wherein, "said equivalent circle" means a circle having the same area as the projected toner particle image, and "an equivalent circle diameter" means the diameter of said equivalent circle.

Herein, as a measurement method of the aforesaid circularity, FPIA-2000 (produced by Sysmec Co., Ltd.) can be employed. The equivalent circle diameter may be defined by the following equation.

An equivalent circle diameter=$2\times$(the projected area of a particle/$\pi)^{1/2}$ In toner utilized in this invention, a slope of a circularity to a circle compared to the equivalent circle diameter is preferably −0.050 to −0.010 and more preferably −0.040 to −0.020. By utilizing such toner, it is possible to more efficiently perform separation of normal toner particles from impurities such as paper dust, broken toner particles, aggregated toner particles and separated external additives contained in toner, while passing toner containing collected non-transferred toner through an toner intermediate chamber provided with a structure to introduce toner from the top and to eject a gas from the bottom.

In the measurement of a slope of a circularity, an equivalent circle diameter is measured by use of Flow Type Particle Image Analyzer FPIA-2000, and the relationship with the corresponding a circularity is drawn making an equivalent circle diameter as the abscissa and closeness to a circle as the ordinate, to determine α as a slope compared to an equivalent circle diameter by observing the first-order correlation thereof ($y=\alpha x+b$).

$R^2$ (R squared) is preferably 0.35-0.95 with respect to increase charging uniformity and halftone uniformity. Herein, R is represented by following general formula (1).

$$R=A/B \qquad \text{General formula (1)}$$

wherein, A and B each represent the following equation.

$$A=n\Sigma XY-(\Sigma X\Sigma Y)B=(n\Sigma X^2-(\Sigma X)^2)\times((n\Sigma Y^2)-(\Sigma Y)^2)$$

X represents an equivalent circle diameter (μm) and Y represents a circularity.

Further, to prepare toner having a slope compared to an equivalent circle diameter, toner particles of a different shape having a slightly larger particle diameter may be mixed into spherical toner having a smaller particle diameter. In addition to this, in a method of preparing toner by aggregation of the resin particles described below, also possible is a method in which the stirring resistance is adjusted by appropriately selecting a stirring fan to produce a condition to more easily provide larger particles with a shearing force after adding a coagulant in the aggregation process, and the method proceeds to a filtering and drying process. It is preferred that a toner manufacturing apparatus and the aforesaid Flow Type Particle Image Analyzer are connected in series to prepare toner by appropriately adjusting the conditions while the average value of a circlarity and the slope α being monitored.

Preferably, when toner particles are grown further to 0.2-1.0 μm, for example, by re-addition of a salting out agent or addition of a surfactant after addition of a stopping agent to stop aggregation, it is possible to control the toner particle size to be in the range of this invention.

EXAMPLE

In the following this invention will be further explained with reference to examples. In the following description, "part(s)" indicates weight part(s) and "%" indicates weight %.

<Preparation of Toners 1-5>

<Preparation of Resin Solution 1>

Bisphenol A ethyleneoxide 2 mole adduct of 343 parts and 166 parts of isophtalic acid were charged into a reaction vessel equipped with a cooling tube, a stirrer and a nitrogen introducing tube to allow reaction under ambient pressure for 8 hours, the system being cooled to 110° C. after allowing further reaction under reduced pressure of 10 to 15 mmHg (1.33-1.99 Pa) for 5 hours, and 17 parts of isophorone diisocyanate in toluene was added to react at 110° C. for 5 hours, followed by being desolvented to prepare "urethane modified polyester (1)" having a weight average molecular weight of 72,000 and an isolated isocyanate content of 0.7%. In a similar manner to the above, 570 parts of bisphenol A ethylene oxide 2-mole adducts and 217 parts of terephthalic acid were subjected to polycondensation at 230° C. for 6 hours to prepare non-modified "polyester (1)" having a number average molecular weight of 2,400, a hydroxyl group value of 51 and an acid value of 5. "Urethane modified polyester (1)" of 200 parts and "polyester (1)" of 800 parts were dissolved in 800 parts of ethyl acetate and mixed to prepare "resin solution 1". Wherein, the Tg of a resin component in "resin solution 1" was 64° C.

| <Preparation of Toner Particles 1> | |
|---|---|
| "Resin solution 1" | 100 parts |
| Carbon black | 12 parts |
| Charge control agent "TP-302" (Hodogaya Chemical Co., Ltd.) | 1 part |
| Carnauba wax | 10 parts |

The above materials were dissolve-dispersed in 200 parts of toluene by rotating a ball mill filled with zirconia beads to prepare "oil phase 1" which would be a dispersed phase.

| | |
|---|---|
| Ion exchange water | 700 parts |
| Sodium dodecylbenzene sulfonate | 1 part |

were mix-dispersed to prepare "water phase 1" which would be a continuous phase. "Oil phase 1" was charged into this "water phase 1" while stirring with a "Homomixer" (produced by Tokushyu Kakoki Co., Ltd.), and "oil droplets 1" having a volume average particle diameter of 1 μm were prepared by adjusting the stirring rate. Thereafter, toluene was removed by decreased pressure evaporating removal at 50° C. to prepare a black "dispersion 1"

The obtained "Dispersion 1" was transferred to a stirring tank equipped with an impeller, and aggregated particles were formed by dropping "aqueous solution 1" comprising 10 parts of aluminum chloride $[Al_2(OH)_4Cl_2]_2$ dissolved in 90 parts of ion exchanged water, while the temperature of the solution was kept at 70° C., thereafter aggregation due to coagulation on melting was confirmed using a scanning electronmicroscope, partial sampling.

After that, the system was stirred at 95° C. for 8 hours, and cooled, after which stirring was stopped when the circularity of aggregated particles was 0.963.

Then, water washing and filtration were repeated, and the obtained cake was dried at a reduced pressure to further increase a circularity resulting in preparation of black "toner particles 1".

(Mixing of External Additives)

Obtained "toner particles 1" of 100 parts, 0.8 parts of needle-formed titanium oxide (having a major diameter of 120 nm, after treatment by n-decyltrimethoxysilane), 1.8 parts of spherical mono-dispersed silica (silica sol prepared by a sol-gel method was subjected to HMDS treatment, being dried and ground, having a particle diameter of 137 nm) and 0.3 parts of hydrophobic silica (manufactured by a gas phase method and having been treated by octylmethyoxysilane, having a particle diameter of 14 nm), were mixed in a HENSCHEL MIXER at a circumferential rate of 30 m/s for 15 minutes. Then, coarse grains were removed by use of a 45 μm shieve to prepare "toner 1". Herein, there was no change of the shape and particle diameter with respect to the "toner 1" by addition of an external additive.

<Preparation of Toners 2-5>

Toners 2-5 were prepared in a similar method to toner 1, except that an average circularity, the average equivalent circle diameter and a slope of a circularity compared to an equivalent circle diameter were controlled according to the manufacturing method described in JP-A No. 2000-214629.

In Table 1, shown are the average circularity, the average equivalent circle diameter and the slope compared to the circularity of toners 2-5.

TABLE 1

| Tones | Average circularity | Average equivalent circle diameter | Circularity compared to equivalent circle diameter |
|---|---|---|---|
| 1 | 0.976 | 5.1 | −0.022 |
| 2 | 0.967 | 5.2 | −0.037 |
| 3 | 0.932 | 5.6 | −0.048 |
| 4 | 0.956 | 7.8 | −0.053 |
| 5 | 0.923 | 7.6 | −0.055 |

<Evaluation of Image Forming Method Utilizing Toners 1-5>

Each of "toners 1-5" was mixed with a "carrier" of 60 μm comprising manganese ferrite having been coated with silicone by use of a HENSCHEL MIXER to prepare "developers 1-" having a toner concentration of 6 weight %.

With respect to prepared developers 1-5, employing image forming apparatus (A) or image forming apparatus (B) described in FIG. 1, in which toner intermediate chamber 242 was removed, preventing classification of toner and impurities, a halftone image was formed on both surfaces of a transfer sheet (having a basis weight of 200 $\mu m^2$), after which the following evaluations were performed.

<Transfer Defect>

Generation of white spots as a transfer defect in the formed image was visually evaluated.

A: No transfer defects were generated.

B: One or two transfer defects per image on 100 sheets were generated only on the rear side, however, they cannot be recognized without close observation, which causes no problem in practical use.

C: One or two transfer defects per image on 50 sheets were generated, however, they could be noticed only by close observation, which causes no problem in practical use.

D: At least five distinct transfer defects per image on 50 sheets on either the front or rear were generated (being of inferior quality).

<Classification Efficiency of Paper Dust>

Toner during image formation was sampled, and determined was an area ratio of the carbon peak arising from a toner resin to the calcium peak arising from calcium carbonate as a filler, by use of an energy dispersion type fluorescent X-ray analyzer. The evaluation ranks were as follows.

A: No calcium peak was detected (excellent rating).

B: The calcium peak was less than 1% of the carbon peak (rated as good).

C: The calcium peak was 1-5% of the carbon peak (practical for commercial use).

D: The calcium peak was not less than 5% of the carbon peak (impractical rating).

<Carrier Contamination>

The surface of the carrier of an image forming apparatus after having been utilized in image formation was observed through an electric field effect type scanning electronmicroscope at a magnification of 40,000.

A: External additives isolated from toner were rarely seen adhering on the carrier.

B: Two-10 pieces of external additives, isolated from toner, were observed in a 1 $\mu m^2$ area, however, no charging hindrance was caused, resulting in no practice problem.

C: At least 11 pieces of external additives, isolated from toner, were observed in a 1 $\mu m^2$ area, which caused a tendency to decrease the charge amount by 4-10 μC/g weight parts compared to the initial value.

D: At least 30 pieces of external additives, isolated from toner, were observed in a 1 $\mu m^2$ area, which caused a decrease of the charge amount by at least 10 μC/g weight parts compared to the initial value, in addition to toner spattering and fogging.

<Durability of Developer>

After image formation on 2,500,000 sheets, the state of the developer was evaluated.

A: No change of the developer was required over the 2,500,000 printing run.

B: Change of the developer was required between the 1,000,000$^{th}$ and 2,500,000$^{th}$ sheet (Good rating).

C: Change of the developer was required before 1,000,000$^{th}$ sheet (Inferior rating).

<Generation of Image Streakings>

Further, images were stored under high temperature and high humidity (33° C. and 90% RH) for 2 hours, after which an image, comprising 8 point characters, was evaluated for bleeding streaks of toner particles.

A: No image streaking was observed.

B: One or two cases of image streakings per A3 size sheet was observed, however, they could not be noticed without close inspection, which causes no problem in practical use.

C: Three or more distinct toner blisters per A3 size sheet were observed (unacceptable).

<Pass-Through>

This characteristic was evaluated based on the number of sheets printed until cleaning defects were generated, due to pass through at the cleaning device of an image forming apparatus, by which image formation was performed, requiring change of the cleaning blade.

A: Change of a developer was not required until after the 1,000,000$^{th}$ printed sheet (excellent rating).

B: Change of a developer was required between the 500,000$^{th}$ and 1,000,000$^{th}$ sheets print (good rating).

C: Change of a developer was required before the 500,000$^{th}$ printed sheet (inferior rating).

These evaluation results are shown in Table 2.

TABLE 2

| Developer | Image forming apparatus | Transfer-off defect | Classification efficiency of paper dust | Carrier contamination | Developer durability | Generation of image streaks | Pass through | Remarks |
|---|---|---|---|---|---|---|---|---|
| 1 | A | A | A | A | A | A | A | Inv. |
| 2 | A | A | B | A | B | A | B | Inv. |
| 3 | A | C | C | D | C | C | C | Comp. |
| 4 | A | C | C | D | C | C | C | Comp. |
| 5 | A | C | C | D | C | C | C | Comp. |
| 1 | B | D | D | D | C | C | C | Comp. |

Inv.: Invention
Comp.: Comparison

It can be seen in Table 2 that an image forming method of this invention can achieve excellent results. Further, in the image forming method of this invention, non-transferred toner remaining on a photosensitive element can be reused to enhance resource saving and cost reduction.

The invention can provide an image forming method in which impurities contained in toner can be efficiently removed, and satisfactory images can be formed on various types of recording media, as well as producing resource savings and reduced costs.

This application is based upon claims the benefit of priority from the prior Japanese Patent Application No. 2003-59760, filed Mar. 6, 2003, the entire contents of which are incorporated herein by reference.

What is claimed is:

1. An image forming method comprising the steps of:

developing an electrostatic latent image formed on an image carrying member with a development device to form a toner image with toner particles comprising a resin prepared by a poly addition or polycondensation reaction, the toner particles having an average circularity of 0.94-0.99, an average equivalent circle diameter of 2.6-7.4 μm, and a slope of a circularity compared to an equivalent circle diameter from −0.050 to −0.010;

transferring the formed toner image on a transfer material;

fixing the formed toner image on the transfer material after the transferring;

collecting non-transferred toner remaining on the image carrying member;

passing the collected non-transferred toner through a toner intermediate chamber, wherein the toner intermediate chamber is provided with a cylindrical or conical structure oriented in a vertical direction which separates paper dust or toner granules toward the bottom of said toner intermediate chamber by utilizing spiraling flow formed from a gas introduced into the intermediate chamber from the development device;

mixing the collected non-transferred toner with the gas in the spiraling flow to separate paper dust or toner granules from the collected non-transferred toner; and transporting the mixture of separated collected non-transferred toner and gas from the toner intermediate chamber to the development device via a suction produced by an air-pump motor so as to reuse the separated collected non-transferred toner, wherein the gas returned to the development device in the transporting of the mixture of the separated collected non-transferred toner and gas is re-introduced into the intermediate chamber to form the spiraling flow.

2. The image forming method of claim 1, wherein the resin is polyester, amorphous polyester, polyurethane, epoxy or polyol.

3. The image forming method of claim 1, wherein the resin is amorphous polyester resin.

4. The image forming method of claim 3, wherein the amorphous polyester resin is urethane modified polyester resin.

5. The image forming method of claim 1, wherein the average circularity is from 0.95 to 0.98.

6. The image forming method of claim 1, wherein the average equivalent circle diameter is 3.4-6.6 μm.

7. The image forming method of claim 1, wherein the slope of a circularity against an equivalent circle diameter is −0.040 to −0.020.

8. The image forming method of claim 1, wherein the average circularity is 0.95-0.98; and the average equivalent circle diameter is 3.4-6.6 μm.

9. The image forming method of claim 8, wherein the slope of circularity to an equivalent circle diameter is −0.040 to −0.020.

10. The image forming method of claim 1, wherein the toner contains a releasing agent.

11. The image forming method of claim 10, wherein the releasing agent has a melting point in a range of 40-150°C.

* * * * *

UNITED STATES PATENT AND TRADEMARK OFFICE

CERTIFICATE OF CORRECTION

PATENT NO. : 7,625,686 B2
APPLICATION NO. : 10/791480
DATED : December 1, 2009
INVENTOR(S) : Ohmura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 863 days.

Signed and Sealed this

Second Day of November, 2010

David J. Kappos

David J. Kappos
*Director of the United States Patent and Trademark Office*